US007653951B2

(12) United States Patent
Gübeli et al.

(10) Patent No.: US 7,653,951 B2
(45) Date of Patent: Feb. 2, 2010

(54) FLUSHING DEVICE COMPRISING A PRESSURIZED CHAMBER AND EVACUATION FITTING FOR A FLUSHING DEVICE AND SYSTEM COMPRISING A FLUSHING DEVICE AND A TOILET BOWL

(75) Inventors: Albert Gübeli, Rapperswil (CH); Mario Von Ballmoos, Jona (CH); Peter Schmucki, Eschenbach (CH); Stefan Grob, Jona (CH)

(73) Assignee: Geberit Technik AG, Jona (CH)

( * ) Notice: Subject to any disclaimer, the term of this patent is extended or adjusted under 35 U.S.C. 154(b) by 544 days.

(21) Appl. No.: 10/526,968

(22) PCT Filed: Sep. 8, 2003

(86) PCT No.: PCT/CH03/00603

§ 371 (c)(1),
(2), (4) Date: Mar. 7, 2005

(87) PCT Pub. No.: WO2004/025039

PCT Pub. Date: Mar. 25, 2004

(65) Prior Publication Data

US 2005/0251904 A1 Nov. 17, 2005

(30) Foreign Application Priority Data

Sep. 10, 2002 (CH) ..... 1534/02

(51) Int. Cl.
*E03D 3/10* (2006.01)

(52) U.S. Cl. ..... 4/354; 4/324; 4/415

(58) Field of Classification Search ..... 4/326, 4/354, 359–362, 324, 415
See application file for complete search history.

(56) References Cited

U.S. PATENT DOCUMENTS 1,639,288 A 8/1927 Giardino et al.
1,645,264 A 10/1927 Vergara (Continued)

FOREIGN PATENT DOCUMENTS

DE 27 02 639 A 7/1978

(Continued)

OTHER PUBLICATIONS

International Search Report for PCT/CH03/00603 dated Mar. 18, 2004.

*Primary Examiner*—Tuan N Nguyen
(74) *Attorney, Agent, or Firm*—Sughrue Mion, PLLC

(57) ABSTRACT

A flushing device comprising an evacuation fitting (6) that is provided with a sealing member (7) within a pressurized container (2). The sealing member (7) is lifted counter to the pressure of a piston (16) in order to initiate the flushing process. A connecting device (39) for a water pipe (24) is disposed on the container (2). The flushing device further comprises a structure (49, 50) for flushing with a partial quantity of the flushing water. For example, the structure (49, 50) is provided with a power-loaded part (50) which moves the valve member (7) down onto the valve seat (5) of the evacuation fitting (6) when the flushing process is interrupted. In an alternative embodiment, two chambers are provided, only one of which is emptied during partial flushing. Flushing water can be conserved by the fact that the flushing process can be interrupted.

20 Claims, 4 Drawing Sheets

U.S. PATENT DOCUMENTS

Figure 1:
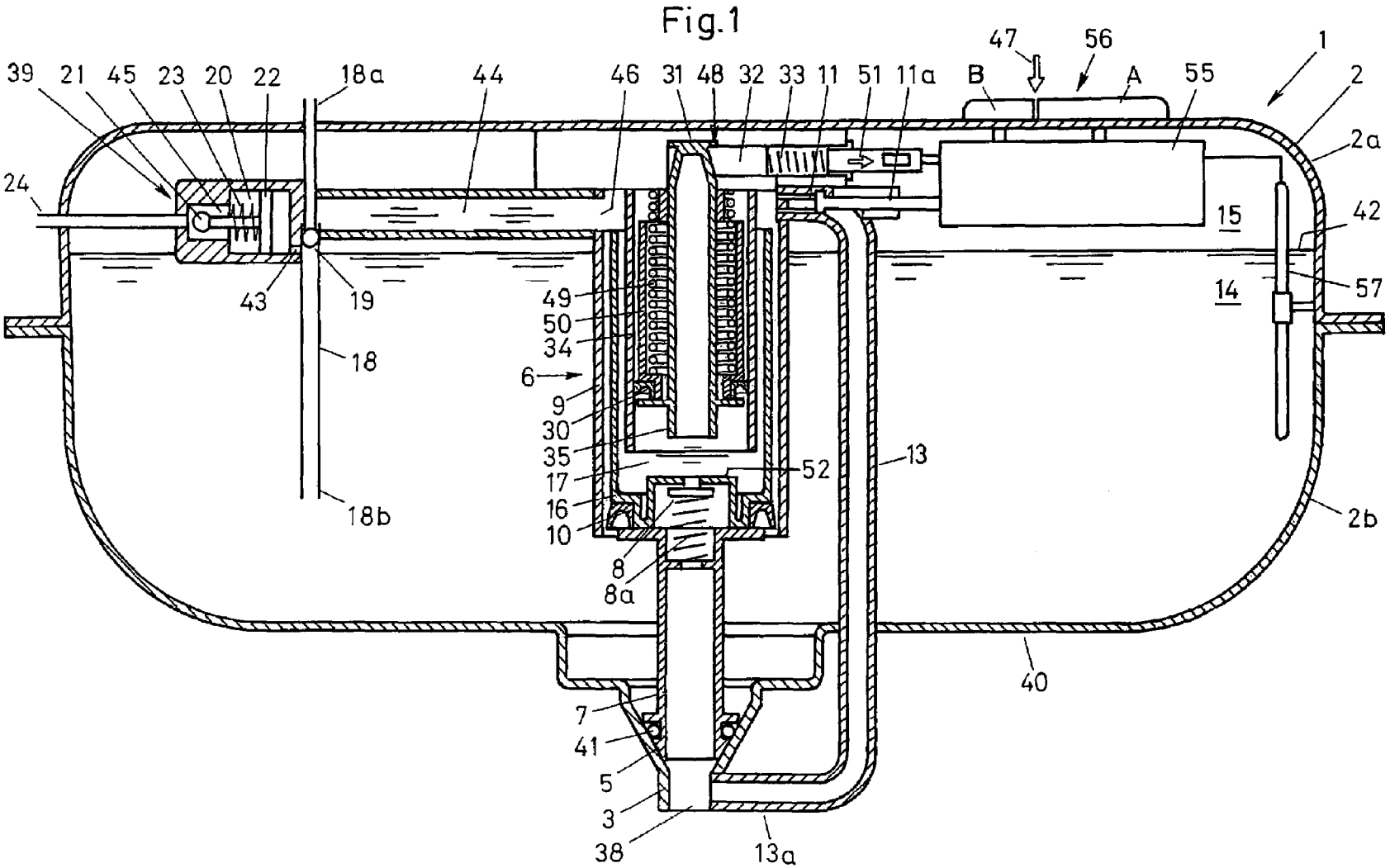

| | | | | |
|---|---|---|---|---|
| 3,605,125 | A | 9/1971 | Gibbs et al. | |
| 5,881,399 | A * | 3/1999 | Kartoleksono et al. | 4/326 |
| 5,970,527 | A * | 10/1999 | Martin et al. | 4/361 |
| 6,219,855 | B1 | 4/2001 | Hsu | |
| 6,550,076 | B1 * | 4/2003 | Fish | 4/359 |

FOREIGN PATENT DOCUMENTS

| | | | |
|---|---|---|---|
| DE | 31 30 452 | A | 7/1983 |
| DE | 36 40 216 | A | 5/1988 |
| EP | 1 156 166 | A | 11/2001 |
| GB | 497 765 | A | 12/1938 |
| GB | 1332995 | A | 10/1973 |

* cited by examiner 405
404
403
401
402
408
406
409
410
411

405
404
403
402
401
406
407
409
410
411

405
404
403
402
406
401
408
407
409
410
411

FLUSHING DEVICE COMPRISING A PRESSURIZED CHAMBER AND EVACUATION FITTING FOR A FLUSHING DEVICE AND SYSTEM COMPRISING A FLUSHING DEVICE AND A TOILET BOWL

The invention relates to a flushing device according to the precharacterizing clause of claim 1.

Flushing devices of the type mentioned have been known for a long time and are also referred to as pressurized flushing cisterns. In these flushing devices, the water present in the flushing container is, in the inoperative state, under the pressure of a pressure space present above the water. The pressure space contains air which cannot leave the container and is at a positive pressure. The positive pressure is produced during the refilling of the flushing cistern. When a flushing process is initiated, the sealing member of the evacuation fitting is raised and the flushing water present in the container is delivered into a lavatory bowl by release of the pressure from the air of the pressure space. The flushing water therefore leaves the container not only under its own weight but also under the action of the pressure space. The pressure in the container causes the flushing water to be delivered at increased speed during a flushing process. One example of a flushing device of this type has been disclosed in U.S. Pat. No. 6,343,387 B1. The advantage of flushing devices of this type is, in particular, that flushing can be carried out with comparatively little water or high energy.

U.S. Pat. No. 2,957,181 has also disclosed a flushing device, in which a spiral spring is provided and is used to keep flushing water in a chamber under pressure. In a flushing process, the flushing water is discharged by release of the tension from the flushing spring.

The invention is based on the object of providing a flushing device of the type mentioned at the beginning which makes it possible to conserve even more flushing water. The object is achieved in the case of a flushing device of the generic type in accordance with claim 1. The flushing device has means for flushing with a partial quantity of the flushing water. In the flushing device according to the invention, the flushing process can be interrupted, or two flushing quantities are available in different chambers. As a result, it is possible either to carry out a full flushing process or partial flushing process. It is therefore not necessary in all cases to flush with the entire quantity of flushing water present in the container. Flushing may also be carried out with a partial quantity of the water present where such a partial quantity is sufficient for the flushing process. This is possible in practice in many cases, with the result that with the flushing device according to the invention a great deal of water and, in particular, fresh water can be conserved, which represents considerable progress in an economical and ecological respect.

The interruption to the flushing process may be set as desired or else fixed. In the case of a fixed setting, the flushing quantity for a partial quantity is determined and is, for example, 3 l. The initiation may be mechanical or else contactless. The flushing device is also suitable in particular for an automatic toilet system, in which, for example, sensors automatically initiate a full flushing process or partial flushing process.

According to one development of the invention, provision is made for said means to have a power-loaded part which, in the event of a flushing process being interrupted, moves the valve member down onto the valve seat. This makes it possible using comparatively simple means to effect a rapid interruption during different phases of the flushing process.

According to one development of the invention, the power-loaded part is mounted displaceably in the evacuation fitting. This permits a particularly compact design and has the particular advantage of the installation of the flushing device not being more complicated than previously. The part is integrated fixedly in the evacuation fitting and is installed without further installation steps during the installation of this fitting.

According to one development, provision is made for the power-loaded part to be spring-loaded. This part is kept in the tensioned state by means of a latching device, for example. After the latching device is released, the part acts under the force of the spring on the sealing member and forces the latter into the closing position.

According to one development of the invention, the power-loaded part is mounted in the piston mentioned. During the refilling of the flushing cistern, the power-loaded part is brought into a starting position or inoperative position, with, for example, a compression spring being tensioned. The compression spring may be replaced here by a different power application means, for example a weight or a magnet.

Further advantageous features emerge from the dependent patent claims, from the description below and the drawing.

Figure 3:
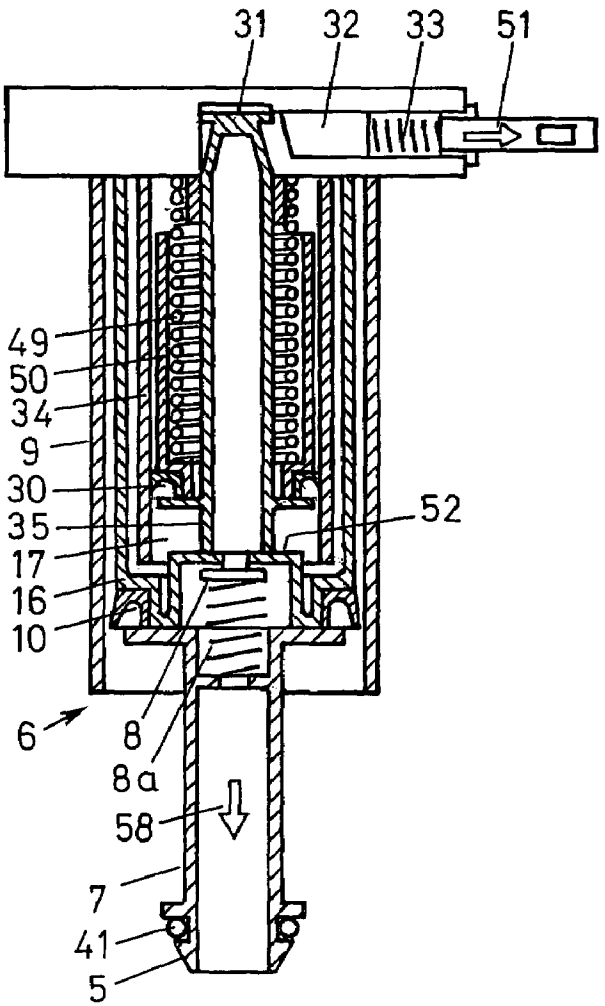
Figure 2:
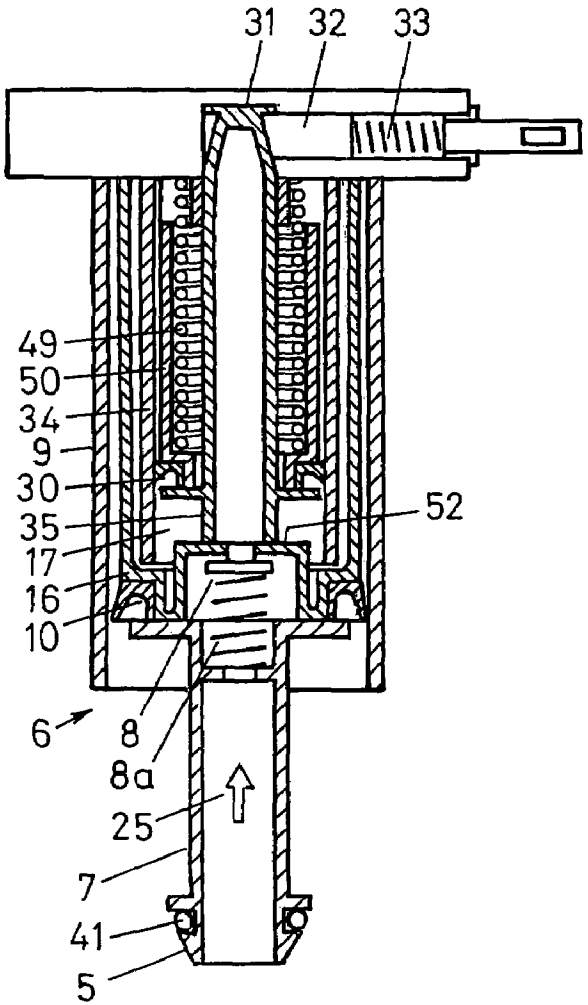
Figure 4:
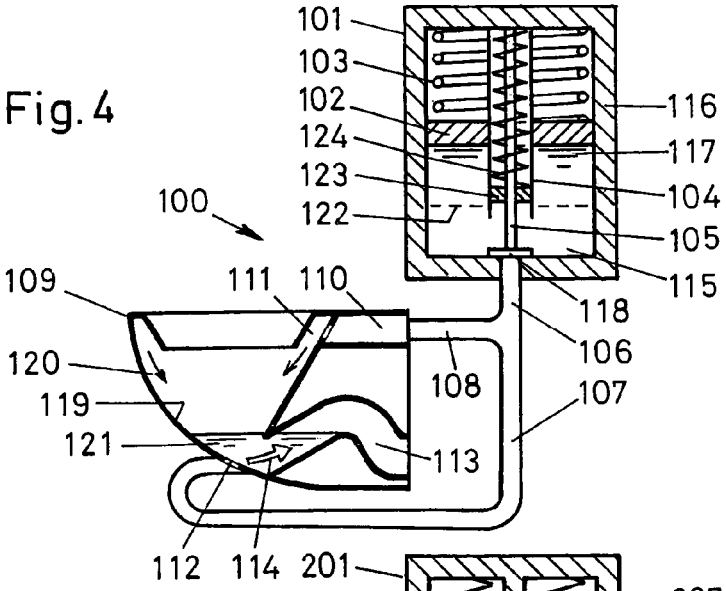
Figure 5:
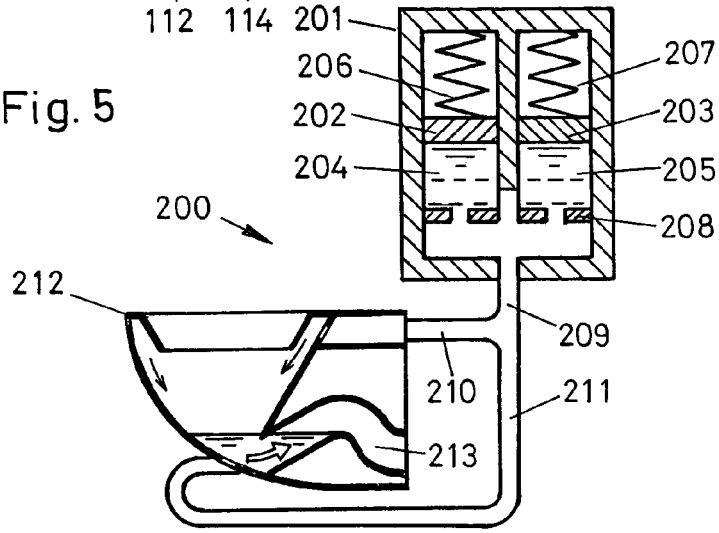
Figure 6:
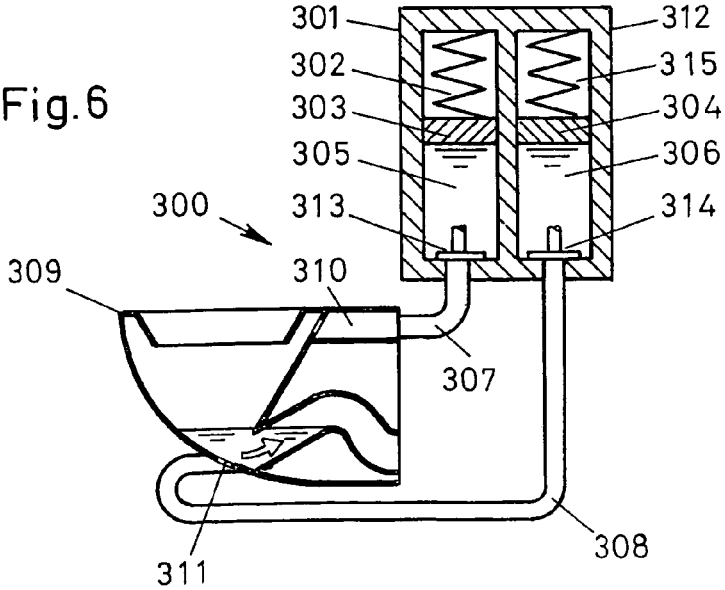
Figure 7C:
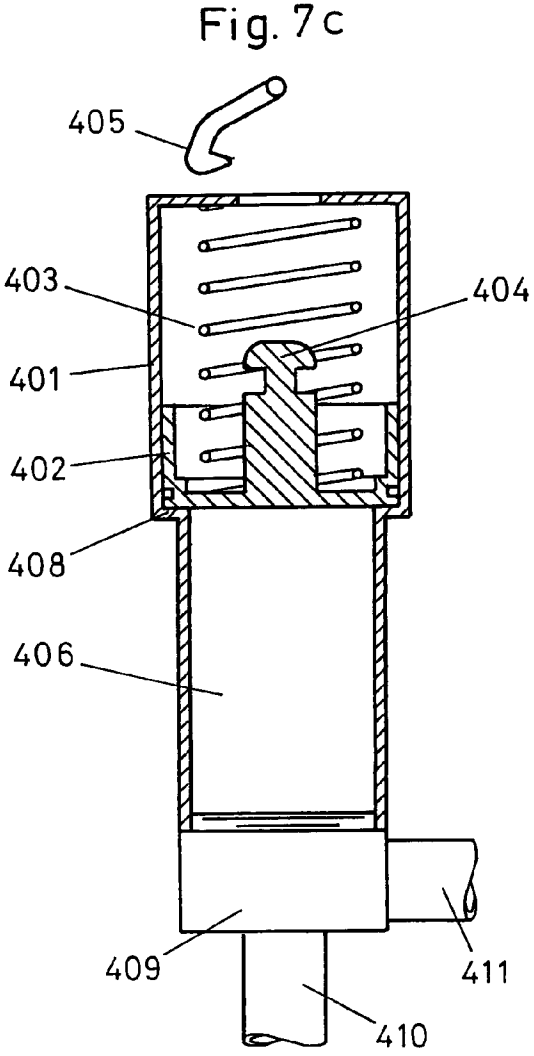
Figure 7B:
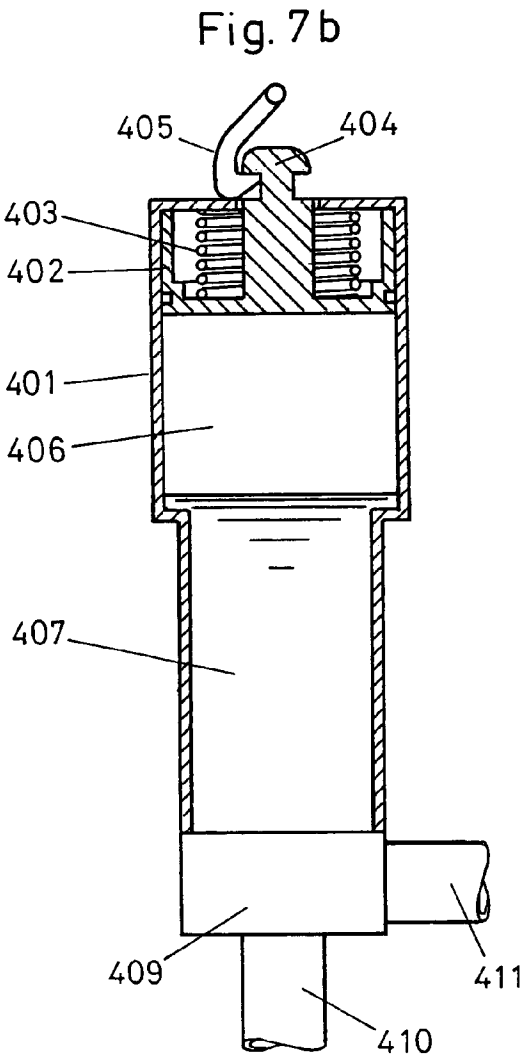
Figure 7A:
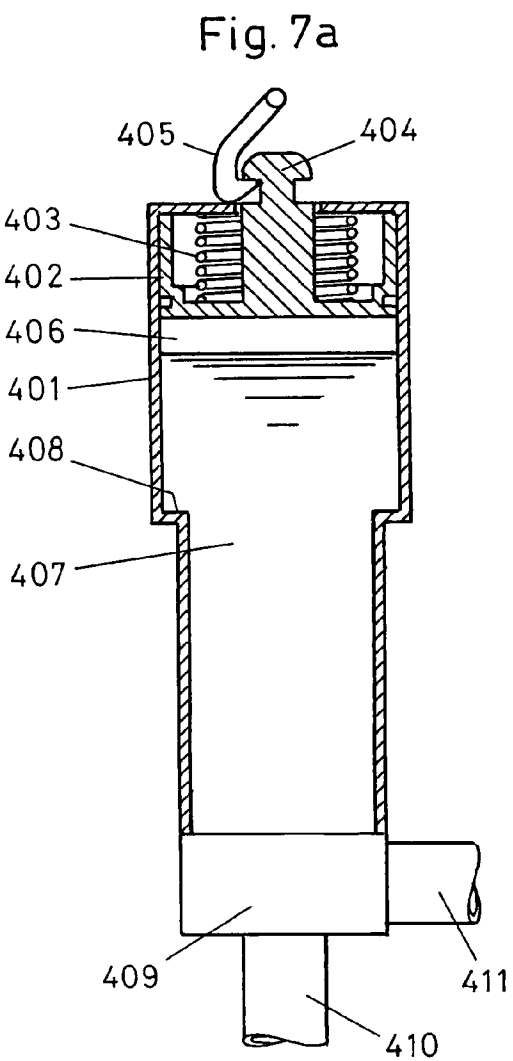

An exemplary embodiment of the invention is explained in more detail below with reference to the drawing, in which:

FIG. 1 shows schematically a section through a flushing device according to the invention, the container being filled with flushing water and being ready for a flushing process, FIG. 2 shows schematically a section through an evacuation fitting shortly after a flushing process has been initiated, FIG. 3 shows schematically a section through the evacuation fitting, an interruption to the flushing process having been initiated, FIG. 4 shows schematically a section through a toilet system with a variant of the flushing device according to the invention, FIG. 5 shows schematically a section through a toilet system with a further variant of the flushing device according to the invention, FIG. 6 shows schematically a section through a toilet system with a further variant of the flushing device, and FIG. 7*a* to 7*c* show schematically sections through a flushing device according to a further variant.

The flushing device 1 shown in FIG. 1 has a container 2 which is a pressure container and comprises, for example, two shell-shaped halves 2*a* and 2*b* which are connected to each other. The container 2 is configured, for example, for an internal pressure of 2 bar. Located in a base 40 of the container 2 is an outlet opening 38 which leads into a connecting pipe 3 which is connected via a flushing bend (not shown here) to a toilet bowl (likewise not shown here). Arranged above the outlet opening 38 is an evacuation fitting 6 which has a sealing member 7, which is mounted displaceably in a guide tube 9 and which has in a lower end a sealing ring 41 which, when the evacuation fitting 6 is closed, rests on a valve seat 5.

According to FIG. 1, the container 2 is filled in the inoperative position with flushing water 14. Above the surface 42 of the flushing water 14 there is a pressure space 15 which contains air. The air is at a positive pressure which acts on the surface 42 of the flushing water 14. The pressure is, for example, 3 bar. A ventilating pipe 18, which is open to the environment at an upper end 18*a* and in which a ventilating valve 19, for example a ball valve, is arranged, is submerged into the flushing water 14. The ventilating pipe 18 likewise serves for refilling the container 2 and, according to FIG. 3, has below the ventilating valve 19 a passage 43 into an internal space 44 of a connecting device 39. The pressure space 15 comprises merely a partial volume of the container 2 that is arranged in the upper region of the container 2. The ventilating pipe 18 is submerged at a lower, open end 18*b* in the flushing water 14.

The connecting device 39 is used for the connection of a pressure water pipe 24, in which there is, for example, a permanent water pressure of approximately 3 bar. The connecting device 39 has a pressure-regulating valve 45 which connects the pressure water pipe 24 to the internal space 44 and, in a valve space 20, has a valve ball 21 which interacts with a valve piston 22 which is tensioned against the valve ball 21 by a tension spring 23. The pressure-regulating valve 45 is closed in FIG. 1.

The sealing member 7 has, at its upper end, a piston 16 with an internal space 17 which is open upward. This internal space 17 is connected to the internal space 44 via a flow gap 46. The internal space 17 is therefore filled with water which, in FIG. 1, is at the same pressure as the water in the internal space 44 and the flushing water 14 in the container 2. The piston 16 is sealed off from the inside of the downwardly open guide tube 9 by an encircling lip seal 10. The internal space 17 is provided at its lower end with a safety valve 8 which has a pressure relief spring 8*a*. If a maximum permissible pressure in the internal space 17 is exceeded, the safety valve 8 opens and delivers water to the outside via the outlet opening 38. When the evacuation fitting 6 according to FIG. 1 is closed, the sealing member 7 is pressed with a force against the valve seat 5 on account of a difference in pressure of pressurizing surfaces. In the case of an internal pressure in the container 2 of two bar, this force is, for example, 7 kp.

The internal space 17 is connected via a ventilating valve 11 to a ventilating pipe 13 which, according to FIG. 1, leads at a lower end 13*a* to above the connecting pipe. The ventilating valve 11 has a valve slide 11*a* which is connected via a control device 55 to buttons A and B of an actuating device 56 in order to close and open the valve 11. In FIG. 1, the ventilating valve 11 is closed. Actuation of the button A or of the button B in the direction of the arrow 47 enables the ventilating valve 11 to be opened. The internal space 17 is then connected to the ambient air. The button A is used to initiate a full flushing process and the button B to initiate a partial flushing process.

As FIG. 1 shows, the evacuation fitting 6 has a further guide tube 34 which is likewise downwardly open and in which a piston-shaped part 50 is mounted displaceably and is sealed off from the guide tube 34 by a lip seal 30. FIG. 1 shows the piston-shaped part 50 in an upper position in which a spiral spring 49 arranged in this part 50 is tensioned. The part 50 has a downwardly protruding section 35 and a locking element 31 at an upper end. The piston-shaped part 50 is preferably of integral design and is, for example, a plastic injection molded part. Together with a slide 32, the locking element 31 forms a locking device 48. A spring 33 keeps the locking slide 32 in the locking position shown in FIG. 1. Displacement of the slide 32 in the direction of the arrow 51 enables the piston-shaped part 50 to be released, so that it is moved downward under the pressure of the spring 49.

The manner of operation of the flushing device according to the invention is explained in more detail below with reference to the drawing.

The flushing device according to FIG. 1 is in the inoperative position and is ready for a flushing process. The air in the pressure space 15 is tensioned at a pressure of, for example, 2 bar. The pressure-regulating valve 39 and also the ventilating valve 19 and the ventilating valve 11 are closed. The evacuation fitting 6 is likewise closed. In order to initiate a full flushing process, the ventilating valve 11 is opened by actuation of the button A. The internal space 17 is thus connected to the ambient air via the ventilating pipe 13. This causes the pressure in the internal space 17 to drop and the sealing member 7 to move, according to FIG. 2, upward in the direction of the arrow 25. As a result, the evacuation fitting 6 is opened and the flushing water 14 is delivered under its own weight and under the pressure of the pressure space 15 through the opening 38, as indicated in FIG. 2. If the level 42 reaches the lower end 18*b* of the ventilating pipe 18, the ventilating valve 19 opens, so that all of the water 14 can be delivered from the container 2.

If all of the flushing water 14 has escaped from the container 2, then a positive pressure no longer prevails in the container 2. The water in the internal space 17 is not used as flushing water and remains in this internal space 17. As a result, the pressure in the internal space 44 drops and the pressure-regulating valve 39 is thus opened. Water then flows via the pressure water pipe 24 into the internal space 44 and through the flow gap 46 into the space 17, so that a pressure slowly builds up again in the internal space 17. At the same time, water passes via the passage 43 into the ventilating pipe 18 and flows downward into the container 2. This water passes via the opening 38 into the toilet bowl (not shown here) and in this case fills up the siphon again. The refilling of the siphon is required if the latter is emptied during a flushing process and has to be refilled as a result.

If the pressure in the internal space 17 is sufficiently large that the frictional force of the lip seal 30 on the guide tube 9 can be overcome, then the sealing member 7 moves downward until the evacuation fitting 6 is closed. The pressure-regulating valve 45 continues to be open, so that, even with the evacuation fitting 6 closed, water flows into the container 2 and fills the latter. Since the ventilating valve 11 is then closed, the air in the pressure space 15 cannot escape and is compressed by the rising water. If the water surface 42 is at the height according to FIG. 1, the pressure in the flushing water 14 is of a sufficient size for the ventilating valve 19 to close. The supply of water into the container 2 is therefore ended. The rise in pressure in the internal space 14 then also closes the pressure-regulating valve 45. The flushing device 1 has therefore reached the inoperative position according to FIG. 1 again and is ready for a further flushing process.

The flushing process explained with reference to FIG. 1 is a full flushing process, i.e. essentially all of the water present in the container 2 is used for the flushing process. The water in the internal space 44 and in the internal space 17 of the piston 16 is excluded here. If only part of the flushing water 14 which is present is required for a flushing process, then the button B is actuated and therefore a partial flushing process is initiated. As explained above, the slide 11*a* is moved via the control device 55 and therefore a flushing process is initiated. According to FIG. 1, the sealing member 7 is prematurely brought into the closing position by a level sensor 57 via the control device 55. For this purpose, the locking slide 32 is displaced, according to FIG. 3, in the direction of the arrow 51 by the control device 55 on the basis of a signal from the level sensor 57. However, the button B may also be connected to the locking slide via a mechanical control device or the release may be initiated via a pressure-controlling means. In this connection, the piston-shaped part 50 is released. When the evacuation fitting 6 is opened, this part 50 bears with the downwardly protruding section 35 against an upper wall 52 of the valve member 7, as FIG. 2 shows. After the release, the piston-shaped part 50 is moved downward under the action of the tensioned spring 49. The force of the spring 49 simultaneously causes the sealing member 7 to move downward. The force of the spring 49 is configured in such a manner that the frictional force of the lip seal 30 on the guide tube 34 can be overcome. According to FIG. 3, the sealing member 7 is moved downward in the direction of the arrow 58 by the piston-shaped part 50 until the evacuation fitting is closed. FIG. 1 shows the sealing member 7 in the lower position in which the evacuation fitting 6 is closed. The flushing process is therefore ended.

The premature closing of the evacuation fitting 6 means that some of the flushing water 14 remains in the container 2. The partial flushing process causes the pressure in the container 2 to drop to such an extent that the ventilating valve 19 opens. The drop in pressure in the internal space 44 also opens the pressure-regulating valve 45 and, accordingly, the container 2 is filled again by water flowing into it. As a result, the abovementioned filling process is initiated and leads again to the inoperative state shown in FIG. 1. The flushing device 1 is then ready again for a flushing process, a full flushing process or partial flushing process.

FIG. 4 shows a toilet system 100 comprising a flushing device 101 and a toilet bowl 109. The flushing device 101 has a container 116 in which flushing water 117 in a chamber 115 is kept under pressure by a piston 102. An evacuation fitting 104 has a sealing member 105 which, in FIG. 4, closes an outlet opening 118. In FIG. 4, the piston 102 is in an upper position and is acted upon by a tensioned spring 103. The spring 103 corresponds to the abovementioned air in the chamber 15. The spring 103 therefore likewise forms a means here in order to deliver the flushing water 117 under pressure from the space 115. If the sealing member 105 is raised, then the flushing water 117 flows via a connecting pipe 106 into a pipe 107 and into a pipe 108. The pipe 108 leads via a distributing chamber 110 of the lavatory bowl 109 into a flushing edge 111 and finally in the direction of the arrows 120 along an inside 119 of the lavatory bowl 109 into a siphon 113. The water flowing through the pipe 107 passes to a nozzle 112 which, in a manner known per se, delivers a jet of water into the siphon water 121 in the direction of the arrow 114. During the flushing process, this jet of water accelerates the siphon water 121, which makes the flushing-out process more effective. The water flowing into the lavatory bowl 109 through the flushing duct 111 cleans the inside 119 of residues.

A partial flushing process is also provided in the case of the toilet system 100. During a partial flushing process, the piston 102 moves, for example, merely as far as the dashed line 122. This is achieved by a premature closing of the evacuation fitting 104. A premature closing of this type is basically possible as explained above. The premature closing can take place, for example, with a part 123 (merely indicated here) which corresponds to the piston-shaped part 50 of FIGS. 1 to 3. For the premature closing, the sealing member 105 is moved downward by means of a spring 124. The interruption may also take place here automatically via a control device 55 which, for example, obtains a signal from a level sensor 57. Owing to the particularly effective flushing with the aid of the nozzle 112, a flushing process with a particularly little amount of flushing water is possible. A full flushing process is possible with substantially less than 6 l of flushing water and a partial flushing process with less than 4 l of flushing water. In this case too, flushing water is conserved in particular by the possibility of a partial flushing process. The flushing device 101 may in principle also be replaced here by the flushing device 1 according to FIGS. 1 to 3.

The toilet system 200 shown in FIG. 5 likewise has a flushing device 201 and a toilet bowl 212. The flushing water delivered by a connecting pipe 209 is likewise divided between two pipes 210 and 211. The water passing through the pipe 211 serves, as explained above, for flushing out a siphon 213 while the water flowing through the pipe 210 at the top into the toilet bowl 212 serves for cleaning the inside of the toilet bowl 212.

The flushing device 201 differs from the flushing device 101 in particular by the fact that here two pistons 202 and 203 are provided and can each be triggered independently of each other and are in each case loaded by a spring 206 and 207, respectively. The movement of the pistons 202 and 203 downward is limited in each case by a stop 208. In FIG. 5, the two pistons 202 and 203 are retained in each case in the upper position and are loaded by a tensioned spring 206 and 207, respectively. If the piston 202 is moved downward into the position shown by dashed lines, then the flushing water situated in a chamber 204 is discharged via the connecting pipe 209 into the pipes 210 and 211. Only a partial quantity of the flushing water present is therefore delivered. This is also the case if the piston 203 is moved downward. The two chambers 204 and 205 may be identical or different. If they differ in volume, two different partial quantities can be delivered. For example, the chamber 204 may contain 2 l of flushing water and the chamber 205 3 l of flushing water. Partial flushing processes either with 2 l or 3 l of flushing water are then possible. For a full flushing process, the two pistons 202 and 203 are moved downward simultaneously. In this case, the flushing water of the chamber 204 and the flushing water of the chamber 205 are therefore discharged. The springs 206 and 207 may also be replaced by an air cushion. The initiation likewise takes place here using two buttons A and B (not shown here). There may also be three buttons here if, as explained, two different partial flushing processes are provided.

FIG. 6 shows a toilet system 300 which has a flushing device 301 and a toilet system 309. The flushing device 301 has a container 312 which has two chambers 305 and 306 in which a respective spring-loaded piston 303 and 304 is displaceably mounted. The chamber 305 is connected via a valve 313 to a pipe 307 which leads into a flushing duct 310. By contrast, the chamber 306 leads via a pipe 308, via a further valve 314, to a nozzle 311. In the inoperative position, the two chambers 305 and 306 are filled with water which is kept under pressure by the piston 303 or 304. The pressure can be exerted by tensioned springs 302 or 315 or by an air cushion. If, when a flushing process is initiated, the piston 303 moves downward, in which case at the same time the valve 313 is of course opened, then flushing water passes out of the chamber 305 through the pipe 307 into the flushing duct 310. In this case, the piston 304 remains in the inoperative position and the flushing water of the chamber 306 likewise remains in the container 301. A flushing process of this type is therefore a partial flushing process in which flushing water passes into the toilet bowl 309 only via the flushing edge 310.

For a full flushing process, the two pistons 303 and 304 are moved downward at the same time. The water from the chamber 305 passes, as mentioned above, via the pipe 307 into the flushing duct 310. At the same time, the flushing water of the chamber 306 passes via the pipe 308 to the nozzle 311 and, as explained above, causes the siphon to be flushed out. It is advantageous here for the flushing water to be placed under pressure separately and to a different extent.

FIGS. 7*a* to 7*c* show a flushing device 400 which has a container 401 in which a piston 402 can be displaced vertically to a limited extent. A valve 409 which is connected to a horizontal outlet 411 and/or a vertically downwardly directed outlet 410 is arranged at a lower end of the container 401. The horizontal outlet 411 leads to a flushing duct (not shown here) and the outlet 410 leads to a flushing nozzle which corresponds, for example, to the flushing nozzle 311 shown in FIG. 6. The movement of the piston 402 is limited by a shoulder 408. A head 404 which protrudes upward out of the container 401 is fastened to the upper end of the piston 402 and is fixed in place by means of a pivotable latching lever 405. According to FIG. 7*a*, the piston 402 is also loaded in the inoperative position by a tensioned spring 403. When the valve 409 is closed, there is a predetermined quantity of flushing water 407 in the container 401. Between this flushing water 407 and the piston 402 there is an intermediate space with air 406 which is at a positive pressure. The positive pressure is produced during the refilling of the container 401, as has been explained above with reference to FIG. 1. The positive pressure is, for example, 2 bar.

The manner of operation of the flushing device 400 is explained in more detail below with reference to FIGS. 7*a* to 7*c*.

FIG. 7*a* shows the flushing device 400 in the inoperative position. It is therefore filled here with flushing water 407 and is ready for a flushing process. To initiate a partial flushing process, the valve 409 is opened. The pressure is therefore released from the air 406 and discharges some of the flushing water 407 out of the container 401. Some of the water passes to the flushing duct and some of the water to the nozzle. A variant is also possible here in which only a passage to the connecting pipe 411 is opened. In this case, the flushing water passes only to the flushing duct. If the pressure has been released from the air 406, the valve 409 is closed. The closing of the valve 409 takes place automatically, for example via a pressure sensor. FIG. 7*b* shows the flushing device 400 after a partial flushing process. The valve 409 is therefore closed again here. The drop in pressure again causes the container 401 to be refilled with water and therefore causes a pressure to be again built up in the air 406. The state shown in FIG. 7*a* is shown again in this case.

If a full flushing process is initiated, then, as explained above, the valve 401 is opened. At the same time, this causes the piston 402 to be released by the latch 405 being pivoted into the position shown in FIG. 7*c*. If the piston 402 is released, the tension can be released from the spring 403 and can move the piston 402 downward into the position shown in FIG. 7*c*. The downwardly moving piston 402 causes an essentially complete displacement of the flushing water 407 and the shifting of the air 406 into the lower region of the container 401, as is shown in FIG. 7*c*. After the flushing process, the valve 409 is closed again and the water flowing in causes, on the one hand, the air 406 to be compressed and, on the other hand, the spring 403 to be tensioned until the piston 402 is again locked to the head 404. The flushing device 400 is then ready again for a partial flushing process or full flushing process. In this case too, the spring 403 may in principle be replaced by an air cushion or by another energy storage means.

The invention claimed is:

1. A flushing device, operative to perform a full flushing process and partial flushing process, comprising:

a container and at least one pressurized chamber, having an actuating device for initiating a flushing process, an outlet valve in the lower region of the container, a connecting device for a water pipe for refilling the container with flushing water, wherein either a partial flushing process or full flushing process can be carried out, an evacuation fitting having a valve member, and a power-loaded part which, during the partial flushing process, is operative to move the valve member of the evacuation fitting and, as a result, the flushing process is prematurely interrupted and, during the full flushing process, remains in an inoperative position.

2. The flushing device as claimed in claim 1, wherein the power-loaded part is mounted displaceably in the evacuation fitting.

3. The flushing device as claimed in claim 2, wherein the power-loaded part is spring-loaded in the inoperative position.

4. The flushing device as claimed in claim 1, wherein the power-loaded part is mounted in the piston mentioned.

5. The flushing device as claimed in claim 1, wherein the power-loaded part is retained releasably in its inoperative position.

6. The flushing device as claimed in claim 5, wherein the power-loaded part is locked releasably in its inoperative position.

7. The flushing device as claimed in claim 6, wherein a locking device is provided for retaining the power-loaded part, said locking device having a slide which interacts with the power-loaded part at the upper end thereof.

8. The flushing device as claimed in claim 1, wherein a piston is fastened to a sealing member at the upper end thereof and has an internal space in which means for the optional premature closing of the outlet valve are mounted.

9. The flushing device as claimed in claim 1, wherein means for the optional premature closing of the evacuation fitting have a downwardly protruding section which bears against the sealing member when the evacuation fitting is open.

10. The flushing device as claimed in claim 1, wherein control means are provided and, during the partial flushing process, automatically interrupt the flushing process.

11. The flushing device as claimed in claim 10, wherein the control means have a level sensor which interrupts the flushing process when a predetermined level of the flushing water is reached.

12. The flushing device as claimed in one of claims 1 to 11, wherein the actuating device has at least two buttons, one button being provided for the full flushing process and the other button being provided for the partial flushing process.

13. The flushing device as claimed in claim 1, wherein the container has two chambers which are connected to each other, only one of the chambers being emptied during the partial flushing process and both chambers being emptied during the full flushing process.

14. The flushing device as claimed in claim 13, wherein each chamber can be emptied by its own piston.

15. The flushing device as claimed in claim 1, wherein the container has two chambers which are separated from each other and of which only one is emptied during the partial flushing process and both are emptied during the full flushing process.

16. The flushing device as claimed in claim 15, wherein each of the two chambers has its own piston for discharging flushing water from the corresponding chamber.

17. The flushing device as claimed in claim 1, wherein the container has a spring-loaded piston, and in that a pressurized air layer is enclosed between the piston and the flushing water.

18. An evacuation fitting for a flushing device as claimed in claim 1, characterized in that it has a power-loaded part which, in order to interrupt a flushing process, interacts with a sealing member in order to move the latter into the sealing position.

19. The evacuation fitting as claimed in claim 18, wherein the power-loaded part is designed as a piston and, in order to interrupt the flushing process, is mounted displaceably in a guide tube.

20. The evacuation fitting as claimed in claim 18 or 19, wherein it is connected to a control device which, during the partial flushing process, automatically closes the valve of the evacuation fitting.

* * * * *